US011339757B2

(12) United States Patent
Jacobs

(10) Patent No.: US 11,339,757 B2
(45) Date of Patent: May 24, 2022

(54) INJECTOR TEST MACHINE

(71) Applicant: DELPHI TECHNOLOGIES IP LIMITED, St. Michael (BB)

(72) Inventor: Lee R. Jacobs, Cubbington (GB)

(73) Assignee: DELPHI TECHNOLOGIES IP LIMITED, St. Michael (BB)

( * ) Notice: Subject to any disclaimer, the term of this patent is extended or adjusted under 35 U.S.C. 154(b) by 104 days.

(21) Appl. No.: 16/757,187

(22) PCT Filed: Oct. 15, 2018

(86) PCT No.: PCT/EP2018/078097
§ 371 (c)(1),
(2) Date: Apr. 17, 2020

(87) PCT Pub. No.: WO2019/076824
PCT Pub. Date: Apr. 25, 2019

(65) Prior Publication Data

US 2020/0340439 A1 Oct. 29, 2020

(30) Foreign Application Priority Data

Oct. 17, 2017 (GB) ..... 1717027

(51) Int. Cl.
*F02M 65/00* (2006.01)

(52) U.S. Cl.
CPC ..... *F02M 65/001* (2013.01); *F02M 65/003* (2013.01); *F02M 2200/85* (2013.01)

(58) Field of Classification Search
CPC ..... F02M 65/001; F02M 65/003; F02M 2200/85; F02M 2200/853; F02M 65/00; F02M 65/008
See application file for complete search history.

(56) References Cited

U.S. PATENT DOCUMENTS

| | | | | |
|---|---|---|---|---|
| 3,117,444 | A * | 1/1964 | Taylor | F02M 65/00 73/114.45 |
| 4,808,005 | A | 2/1989 | Lewis et al. | |
| 5,317,911 | A | 6/1994 | Yaraschefski | |
| 6,425,384 | B1 | 7/2002 | Howarth et al. | |
| 8,915,126 | B2 * | 12/2014 | Friedmann | F02M 65/00 73/114.45 |
| 8,939,019 | B2 * | 1/2015 | Kordass | F02M 65/001 73/114.45 |
| 9,027,394 | B2 * | 5/2015 | Kordass | G01M 15/02 73/114.45 |
| 10,781,781 | B2 * | 9/2020 | Hoss | F02M 65/001 |
| 10,782,208 | B2 * | 9/2020 | Hoss | G01M 15/02 |
| 2013/0206937 | A1 | 8/2013 | Kordass et al. | |
| 2013/0291631 | A1 | 11/2013 | Kordass et al. | |
| 2018/0259423 | A1 | 9/2018 | Hoss et al. | |

FOREIGN PATENT DOCUMENTS

| | | | |
|---|---|---|---|
| CN | 201212437 | Y | 3/2009 |
| CN | 202325962 | U | 7/2012 |
| CN | 106194538 | A | 12/2016 |
| CN | 107035593 | A | 8/2017 |
| CN | 107061095 | A | 8/2017 |
| GB | 2393217 | A | 3/2004 |
| KR | 101255932 | B1 | 4/2013 |

* cited by examiner

*Primary Examiner* — Freddie Kirkland, III
(74) *Attorney, Agent, or Firm* — Joshua M. Haines

(57) ABSTRACT

A fuel injector test machine is provided such that an injector is fixed on a test feature with a manually operable clamp.

19 Claims, 10 Drawing Sheets

INJECTOR TEST MACHINE

CROSS REFERENCE TO RELATED APPLICATIONS

This application is a national stage application under 35 USC 371 of PCT Application No. PCT/EP2018/078097 having an international filing date of Oct. 15, 2018, which is designated in the United States and which claimed the benefit of GB Patent Application No. 1717027.5 filed on Oct. 17, 2017, the entire disclosures of each are hereby incorporated by reference in their entirety.

TECHNICAL FIELD

The present invention relates to a fuel injector test machine.

BACKGROUND OF THE INVENTION

Certain diesel injectors are fitted to a range of medium duty passenger vehicle and off-highway applications. Said injectors use an intensifier system to amplify engine oil pressure between 30-300 bar to generate high injection pressure, 300-2000 bar, for EN590 diesel fuel which is utilized to combustion.

The injector is clamped into the engine using dedicated mounts and removal requires dedicated tooling to support removal of the injector without causing damage due to the tight O-ring squeezes for the hydraulic connection.

During service operations, the injectors are removed from the engine and clamped on a test machine for measuring actual performances such as measurement of injected delivery, measurement of the electrical coil (resistance/inductance) or measurement of injection timing from start of electrical pulse to injection event. Said performance tests enable to properly diagnose the injectors but, service test machines are complex equipment's requiring specific tooling to arrange the injector on the test bed, with similar risk of damaging the injector. Therefore, testing time is long to set up and, at completion a similar long time is needed to remove the injector from the machine. A more simple machine, easier to use is required.

SUMMARY OF THE INVENTION

Accordingly, it is an object of the present invention to resolve the above mentioned problems in providing a test machine adapted to execute high pressure fuel injector tests on several types of fuel injector. Each of said injector has an injector body extending along a longitudinal axis from a head to a spray nozzle tip, the head being provided with an electric connector for transmitting command signals to an actuator cooperating with a valve member controlling injection spray through said tip.

The test machine defines a test chamber wherein the injector can be fixed on a test feature by means of manually operable clamps.

Said manually operable clamps may comprise latch toogle clamps, each of the toogle clamps comprising a handle articulated about a fixation member for stretching a resilient ring, said fixation member being fixed to the test feature.

Also, for fixing the injector said resilient ring is engaged in a hook arranged on the injector head, said hook being part to a test head cap arranged over the injector head or directly bolted to the injector.

The test feature may comprises a base member on which is arranged an interface member, said base member being attached to the machine and being common to all types of injectors and, the interface members being specifically designed for a particular type of injector, to each type of injector corresponding a dedicated interface members.

The interface member may be a sleeve provided with a through bore adapted to receive the nozzle of the injector wherein it is sealingly inserted, the head of the injector protruding outside the sleeve, said sleeve being provided with drillings for inter-connecting a machine high pressure fuel inlet to the injector fuel inlet.

In another aspect of the invention, the test feature is adapted to move between a mounting position and a test position, the mounting position being suitable for arranging the injector on said test feature and, the test position being suitable for testing said injector.

In said test position the longitudinal axis of the injector is substantially parallel to the front wall opening access and in said mounting position, the test feature is tilted toward the opening access to ease the injector arrangement on the test feature.

In said mounting position the longitudinal axis of an injector arranged in the interface member extends through the front wall opening access, or at least in the direction of it.

In an aspect of the invention, the sleeve may be fixed to the base member, the base member being moveable relative to the machine housing.

In another aspect of the invention, the base member is fixed relative to the machine housing and the sleeve is moveable relative to the base member between the mounting position and the test position.

The test machine may further comprise an electronic command unit in a memory of which the tests method executable by the machine are uploaded.

The test machine may further comprise a display connected to said command unit for an operator to select a particular test.

In a particular aspect of the invention, the test machine has a substantially parallelepiped body enclosing said test chamber, said body having a front wall provided with said access opening and, the display is arranged on the front wall above the access opening.

The invention further extends to a method for arranging an injector on a test machine described above, said method comprising the steps of:

- providing an injector to be tested;
- providing a sleeve adapted to the injector of step;
- tilting the base member to the mounting position;
- clamping said sleeve on the base member;
- inserting the injector chosen at step into the sleeve;
- rigidly fixing said injector by downwardly pulling the handles of the latch toggle clamps;
- tilting the base member back to the test position;
- locking the base member into said test position;
- closing the access opening by means of a door;
- selecting on the display the type of injector to be tested;
- selecting on the display the test to be executed.

The invention further extends to a method for removing an injector from a test machine after having performed a test, said method comprising the steps of:

- accessing the injector that has been tested and, unlocking and tilting the base member to the mounting position;
- releasing the latch toggle clamps by upwardly pulling the handles of said latch toggle clamps;
- removing the injector from the sleeve.

BRIEF DESCRIPTION OF THE DRAWINGS

The present invention is now described by way of example with reference to the accompanying drawings in which.

DESCRIPTION OF THE PREFERRED EMBODIMENTS

Figure 1:
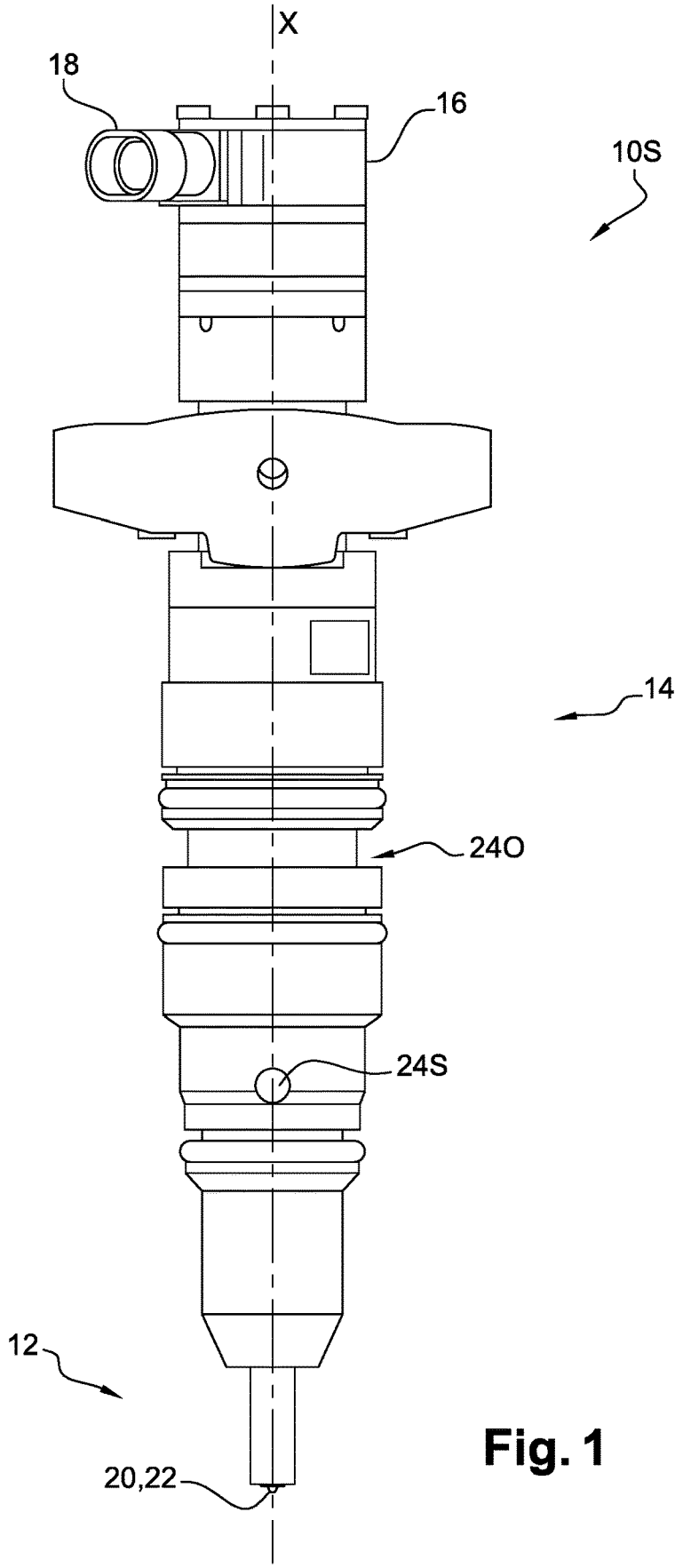
FIG. 1 is a side feed injector to be tested on a test machine of FIG. 2.

In reference to FIG. 1 is briefly presented a diesel fuel injector 10 adapted to be part of a fuel injection equipment of an internal combustion engine. The injector 10 has an elongated shape extending along a longitudinal axis X and it comprise an injection nozzle 12 over which, by means of an injector capnut, an actuator assembly 14 is fixed.

In use, the injector 10 is placed in a well provided on the engine cylinder head, the bottom end of the well opening into a compression chamber. The head end 16 of the injector, where is arranged an electric connector 18 internally connected to an electrovalve, protrudes outside the well and, at the opposite end the tip 20 of the injection nozzle protrudes through said bottom opening for spraying pressurised fuel into said compression chamber.

The fuel injector 10 shown on FIG. 1 is a side feed injector 10S having an engine oil gallery 24O and a diesel fuel inlet 24S sealingly separated by O-rings? The gallery 24O forms an annular groove around the injector and, the fuel inlet 24S opens laterally on the outer face of the injector. In a fuel injection equipment provided with such side feed injectors 10S, engine oil flows toward the injector in the gallery 24O and, diesel fuel enters the injector via said inlet 24S.

Another embodiment of injector 10 is a top feed injector 10T (shown on FIG. 13) having a fuel inlet 24T arranged atop the injector head.

Figure 2:
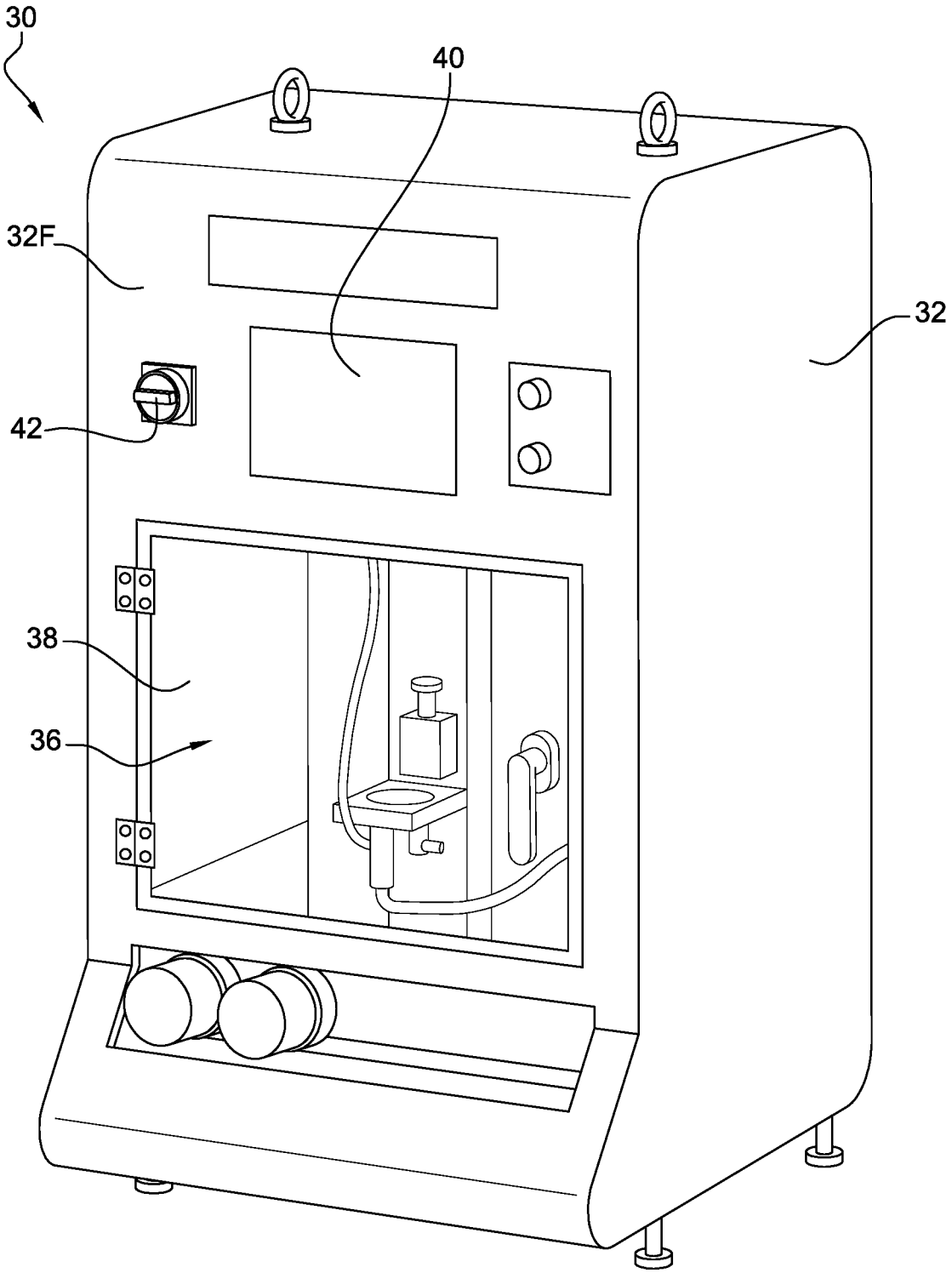
FIG. 2 is an 3D view from the test machine as per the invention.

During life of the injector 10 service may be needed requiring tests and, diagnosis is made in a test machine 30 as generally presented in FIG. 2. Typical tests performed are performance tests involving for instance a measure of current needed to spray high pressure fuel or, a measure of a fuel quantity sprayed in a certain time duration.

The test machine 30 is designed to test several types of injectors 10 all having a similar configuration, as described above, but differing from one another by their actual dimensions, length, diameters . . . .

Said machine 30, designed to be placed on a table, has a substantially parallelepiped body with six lateral walls 32 enclosing a test chamber 34 wherein is a fixed frame to which is attached a test feature 44 adapted to receive a fuel injector 10. On the figure the most visible vertical wall is the "front wall" 32F which in the lower part defines an forwardly advanced portion where control knobs are arranged oriented toward an operator. This front wall 32F is also provided with a rectangular access opening 36 enabling to enter and install the injector in the test chamber 34, said opening being closed by a door 38 laterally rotatable about a vertical axis. Above said opening 36, on the upper part of the front wall 32F, are arranged a "touch-screen" digital display 40 and an emergency stop button 42. A command unit 43 controls the machine as per inputs on said digital display 40. Said front wall arrangement is an example and is presented without intent to limit the application. In alternative embodiments, the knobs and the command display can be differently arranged otherwise on the wall or can be placed on a separate console connected to the machine.

Figure 3:
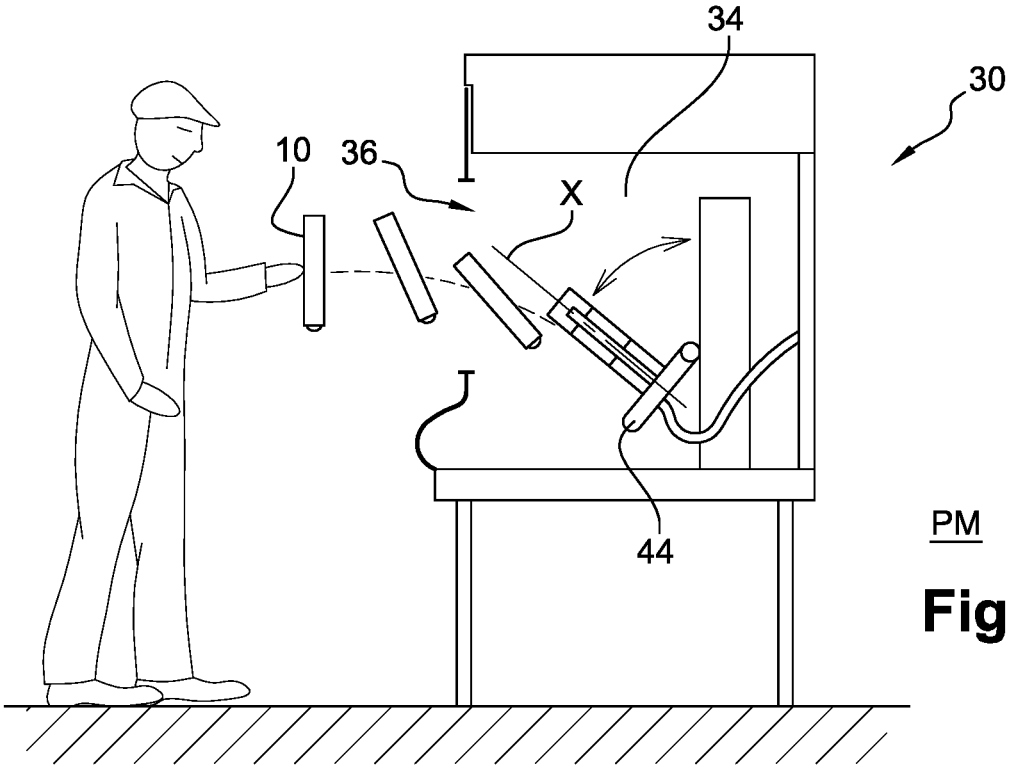
FIGS. 3 and 4 are sketches representing an operator using the machine of FIG. 1.
Figure 4:
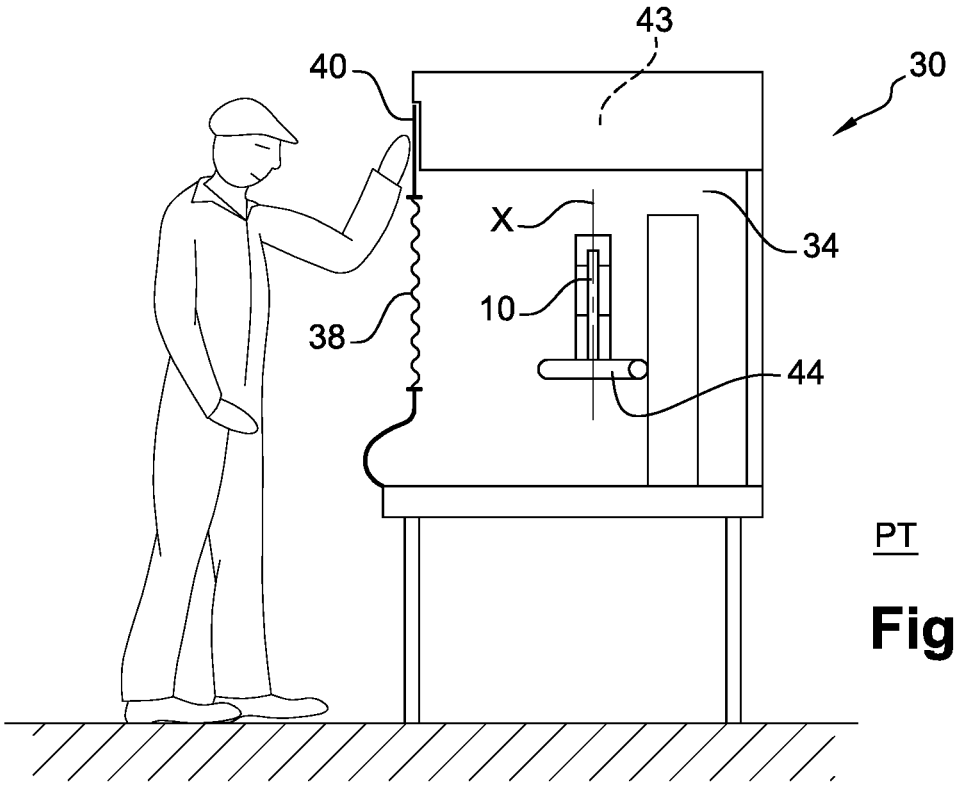

As sketched on FIGS. 3 and 4, an operator can easily arrange an injector 10 in the test chamber 34 by engaging it through the opening 36 and then after closing the door 38, he/she selects on the display 40 the test to be executed.

Figure 5:
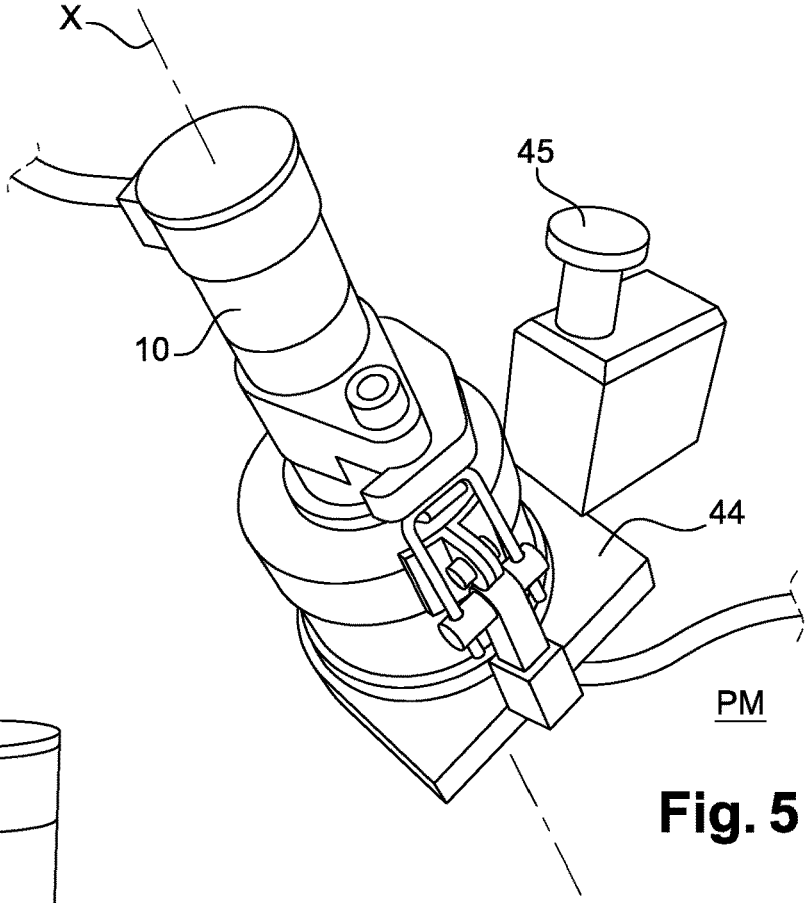
FIG. 5 shows the injector of FIG. 1 arranged in the machine of FIG. 2 in a mounting position such as sketch in FIG. 3.
Figure 6:
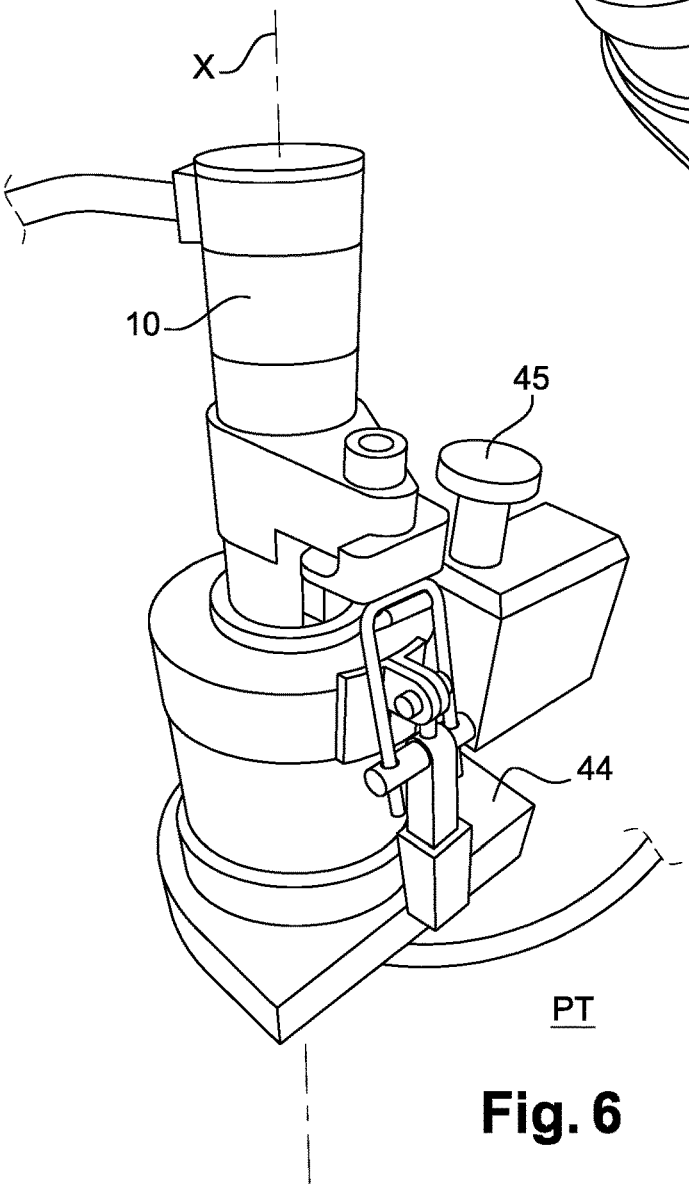
FIG. 6 shows the injector of FIG. 1 arranged in the machine of FIG. 2 in a test position such as sketch in FIG. 4.

In the test chamber 34, the injector 10 is arranged on said test feature 44 that can be moved between a mounting position PM (FIGS. 3 and 5) and, a test position PT (FIGS. 4 and 6). On the example presented, to move between said positions PM, PT the test feature is angularly tilted about an horizontal axis. Alternatively, other arrangements can be made for instance having said test feature translated toward the access opening 36 for easing the injector arrangement.

In the test position PT the injector is fixed in said test feature 44 so the injector longitudinal axis X is parallel to the front wall 32F and, a lock 45 locks the test feature 44 to the frame, the test feature not being able to move during the performance of a test.

The lock 45 comprises a male member integral to the test feature 44 and complementary engage-able in an adjusted female member integral to the frame and, a locking bolt that can be inserted in a bore drilled for part in the male member and for a other part in the body of the female member. In test position PT, the two parts of the bore are aligned and the locking bolt is engaged therein. Alternatively, many other locking mechanism can be provided.

In the mounting position PM the test feature is unlocked and is angularly pivoted toward the access opening 36 so the injector placed in the test feature 44 has its longitudinal axis X extending through, or at least in the direction of, said access opening 36. Consequently, setting the injector in the feature 44 is made easy.

Figure 7:
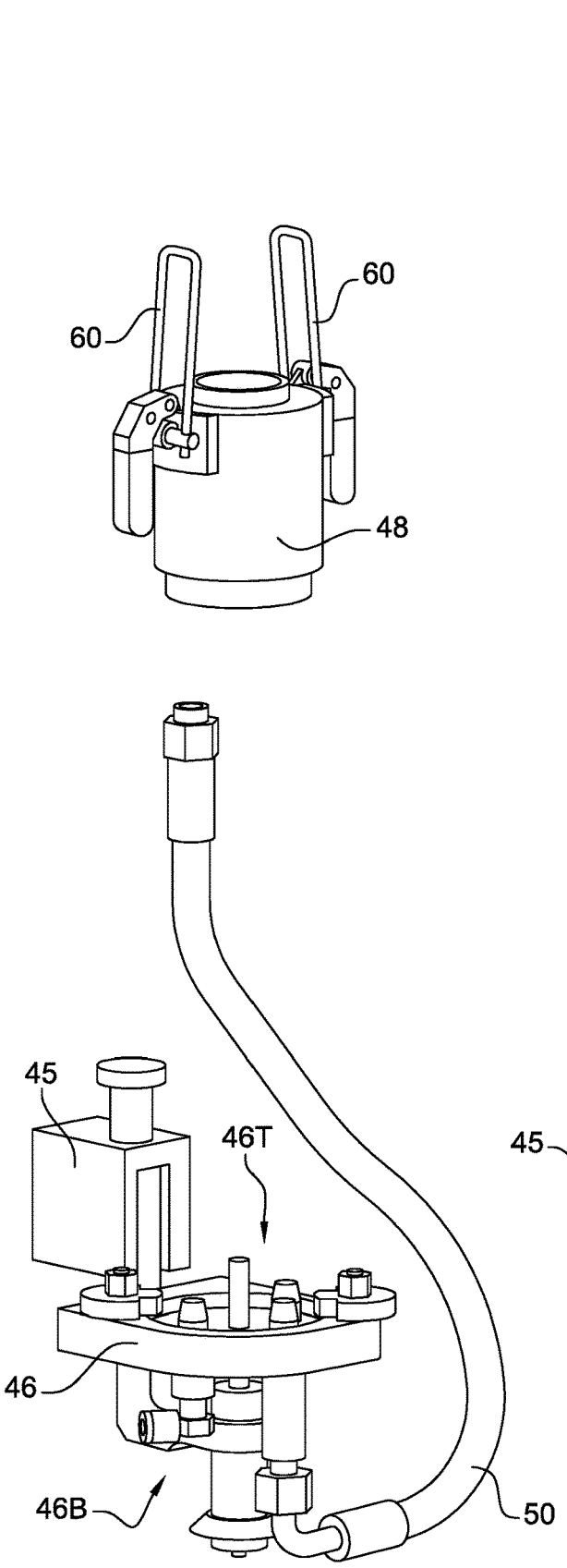
FIGS. 7 and 8 detail the test feature of the machine of FIG. 2.
Figure 8:
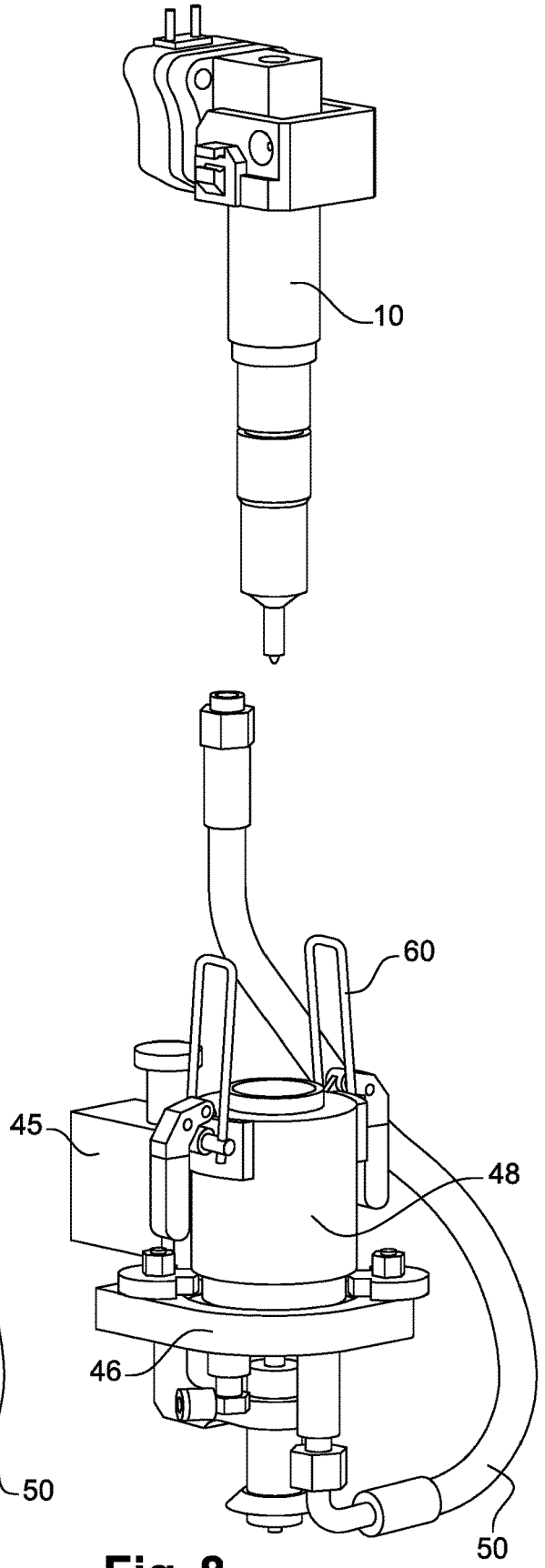

More particularly in reference to FIGS. 7 and 8, said test feature 44 comprises a base member 46 and an interface member 48. The base member 46 is fixed to the frame at it defines a bottom side 46B wherein is hydraulically connected a high pressure fuel pipe 50 and, a top side 46T adapted to receive said interface member 48. The base member 46 is further provided with channels 51 enabling HP fuel to flow out of the pipe 50 into said channels 51, here after described, arranged in the sleeve 48.

The interface member 48 of the present example is a sleeve 48 having a tubular body with an upper end 48U and a lower end 48L for complementary arrangement on the base member 46. Said sleeve 48 defines an axial through bore 52 surrounded by a thick peripheral wall 54 in which retention notches 56 are provided at the lower end 48L of the outer face. Said notches 56 enable to rigidly fixe the sleeve 48 to the base member 46 by means of two clamping plates 58 screwed in the base member top side 46T and engaged in said notches 56. Alternatively an annular groove could be provided replacing said notches and forming a shoulder for the clamps abutment. The injector 10 is inserted in the bore 52 and it is fixed in position by means of two latch toogle clamps 60 themselves fixed on the sleeve 48.

Figure 9:
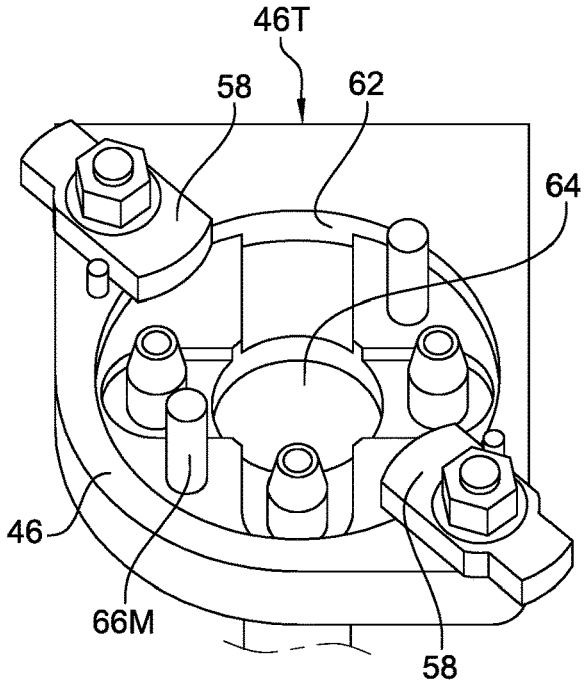
FIG. 9 shows a base member of the test feature.

In reference to the FIG. 9 is presented the top side 46 T of the base member defining a recess 62 for positioning the sleeve 48 and said two clamps 58 diametrically opposed. In said recess 62 a central hole 64 enables the nozzle tip 20 to extend through and, around said central hole 64 protrude HP fuel connections.

Figure 10:
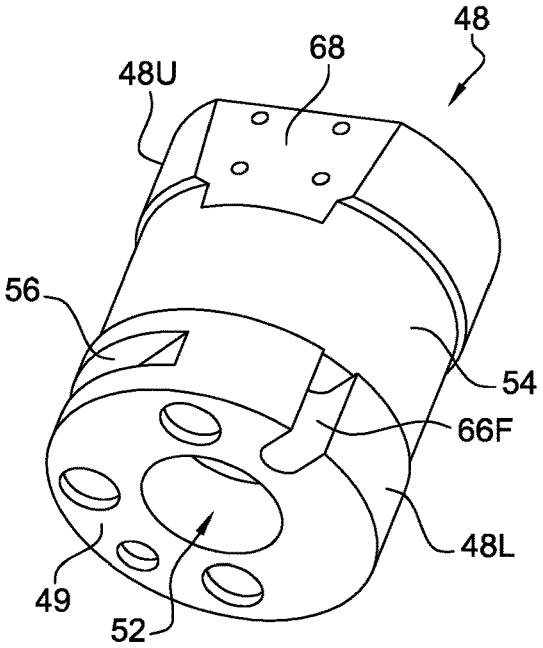
FIGS. 10, 11 and 12 detail an interface member also part of the test feature.

The sleeve 48, presented on 3D FIG. 10 shows the outer face of the wall 54 with the clamping notches 56 (only one being visible) and a positioning slot 66F for complementary engagement of pins 66M extending from the base member on the outer border of the recess 62. Also, said outer face is provided with flats 68 for screwing said toogle clamps 60 on the upper end 48U of the sleeve.

Figure 11:
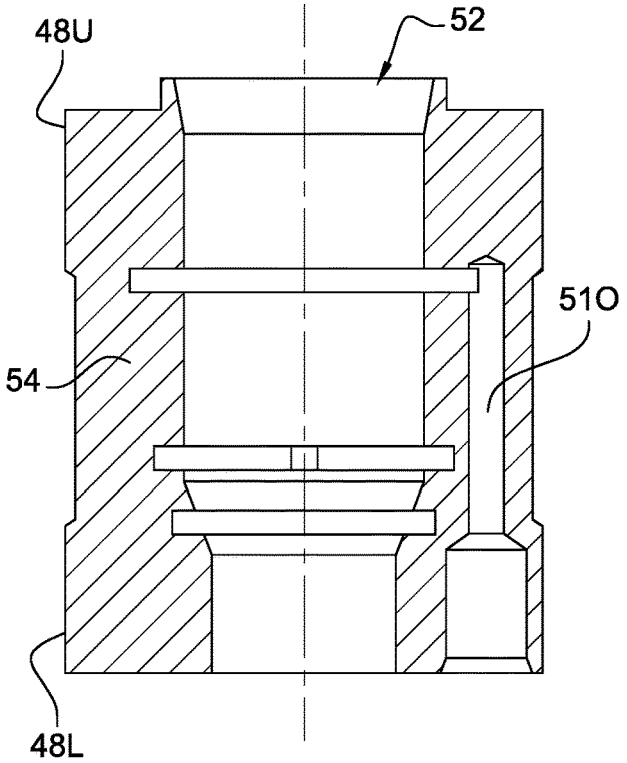
Figure 12:
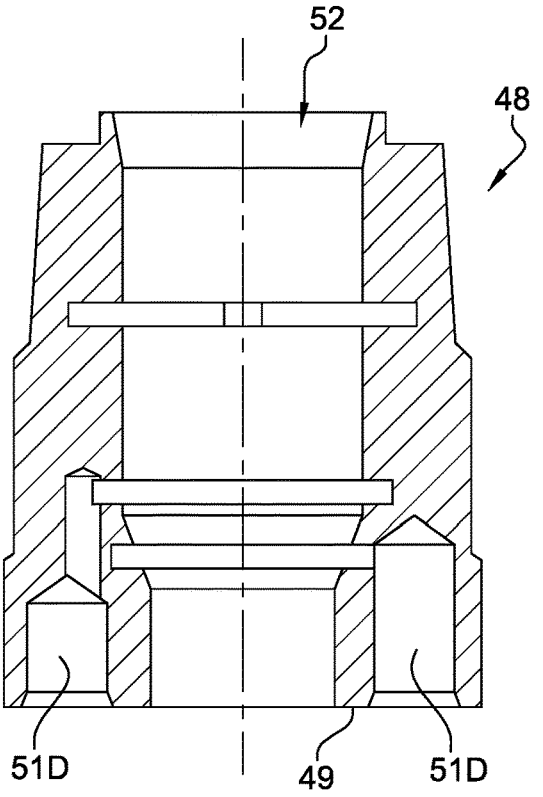

FIGS. 11 and 12 are axial sections of a sleeve specially designed for a side feed injector 10S, said sections being 90° apart from one another. In the thickness of the wall 54 are drilled the vertical channels 51, comprising an oil channel 51O for the engine oil and, two diesel fuel channels 51D (feed and return). Said drillings upwardly extend from an opening in the under face 49 of the sleeve (visible on FIG. 10) to annular gallery in fluid connection with, the oil gallery 24O of the diesel fuel inlet 24S.

For top feed injectors, the sleeve 48, not shown in section, does not need said drillings 51.

The machine 30 has a unique base member 46 attached to the machine and common to all different types of injectors 10, 10S, 10T and, a plurality of sleeves 48, each being specifically made to a specific type of injector 10, 10S, 10T. The sleeve 48 is the interface member between a standard base member 46 and a particular injector 10.

All the sleeves 48 have the same characteristics of through bore 52, notches 56 on the outer face of the wall and flats 68 for fixing toogle clamps 60.

Figure 13:
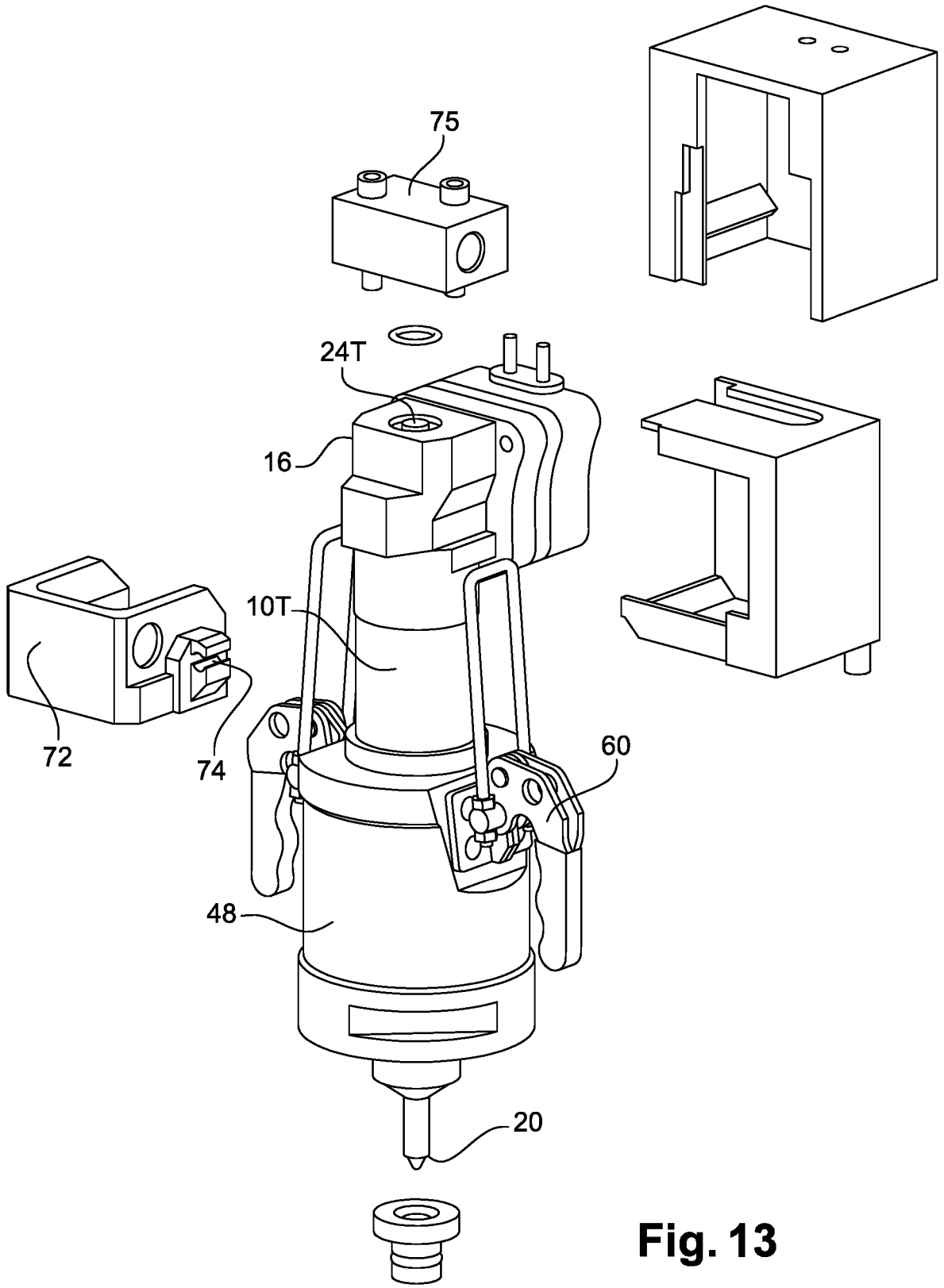
FIG. 13 is an exploded view of a head cap part of the test feature.

In reference to FIG. 13, to maintain the injector 10 in the sleeve 48 (a top feed injector 10T is shown on FIG. 13) a U-shaped member 72 is complementary engaged in clamp grooves of the injector head 16, each arm of said U-shaped member 72 being provided with a hook 74. Also shown on said figure, an inlet block 75 is screwed atop said injector 10T to enable fuel inlet into the top feed injector 10T.

Figure 14:
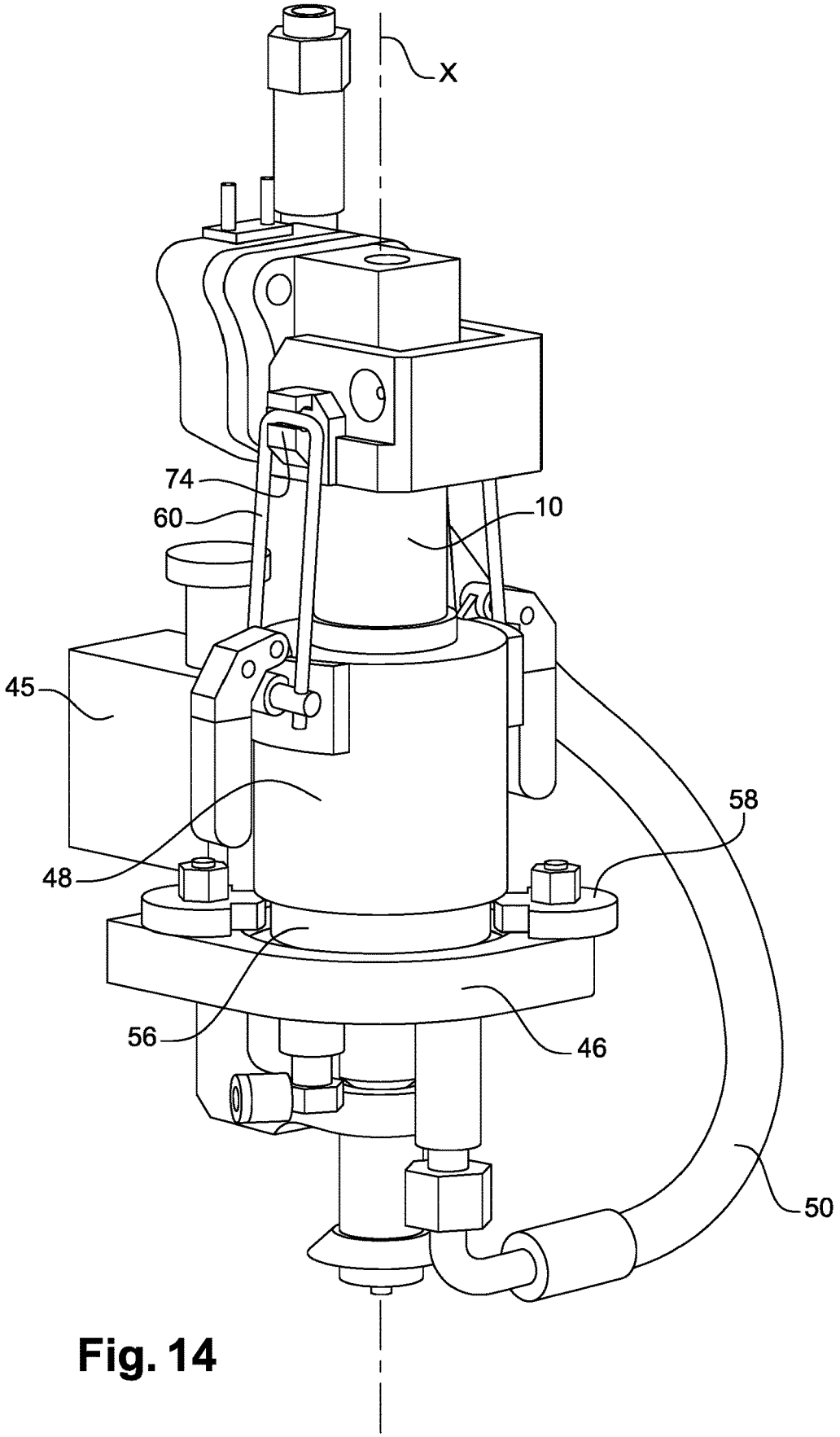
FIG. 14 is a 3D view of the injector fixed in the test feature.

The toogle clamps 60 have a handle and a resilient ring both articulated about a fixation member fixed to the sleeve 48. For fixing the injector 10 each resilient ring is engaged in one of the hooks 74 and, by downwardly pulling the handles, the resilient rings are stretched urging and fixing the injector in the sleeve as presented on FIG. 14. In the example said rings have an elongated rectangular shape although alternatives exist.

Figure 17:
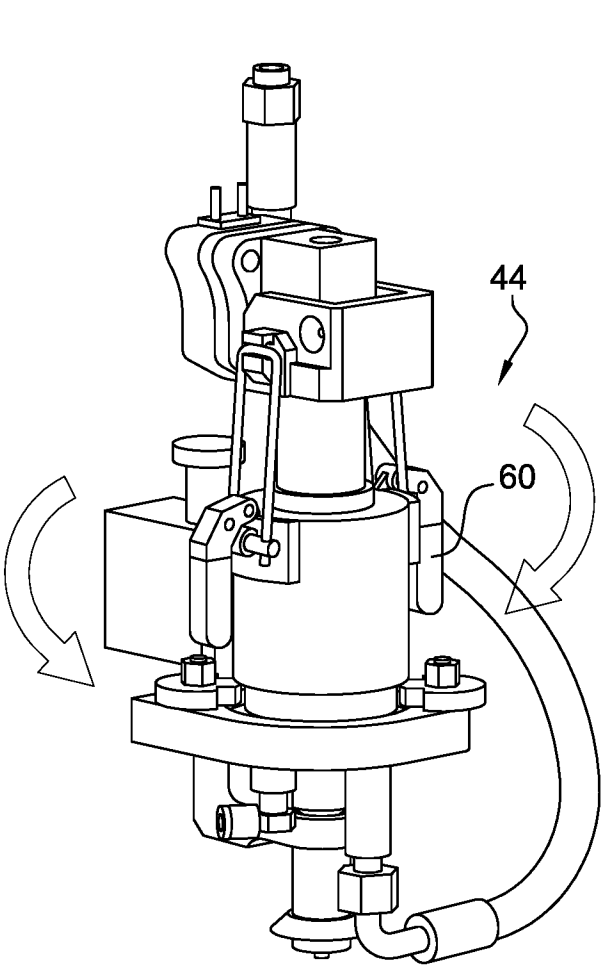
FIGS. 15, 16 and 17 detail the sequence of operations for mounting the injector onto the mounting feature.
Figure 16:
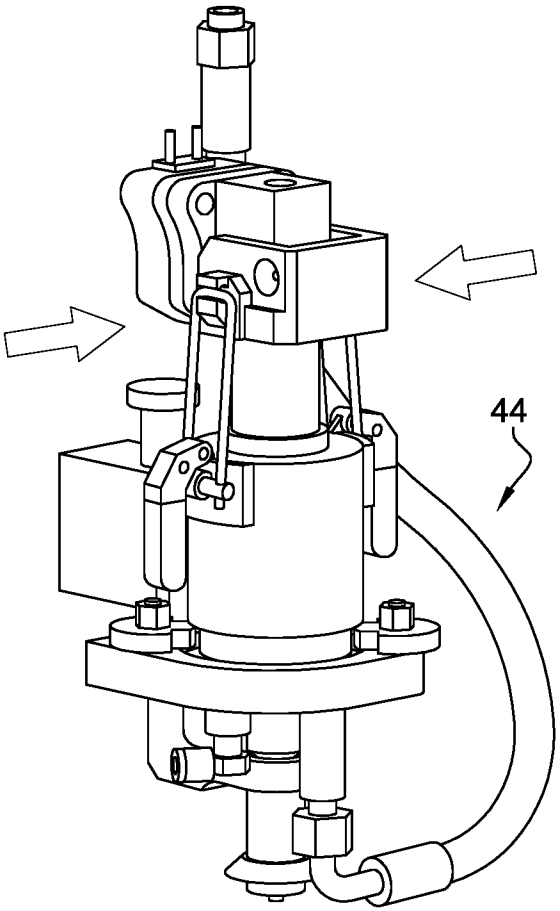
Figure 15:
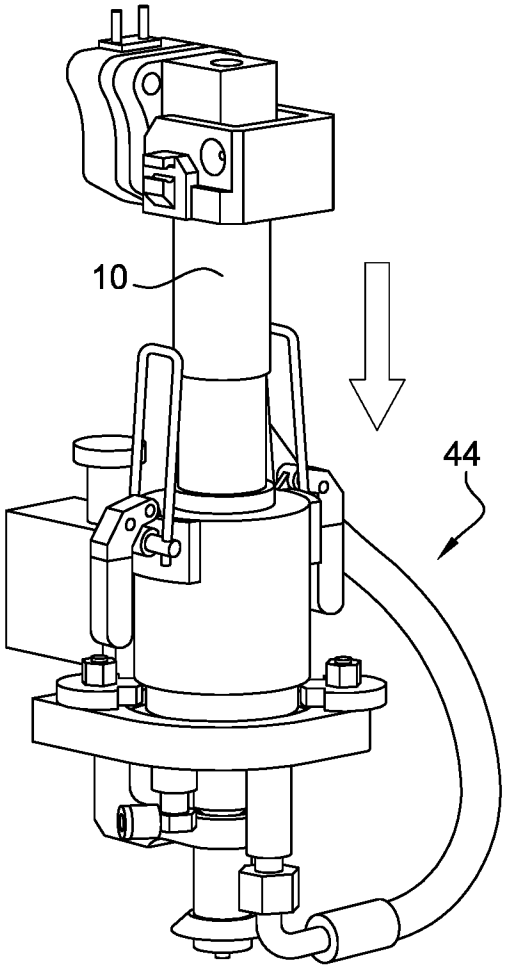
Figure 20:
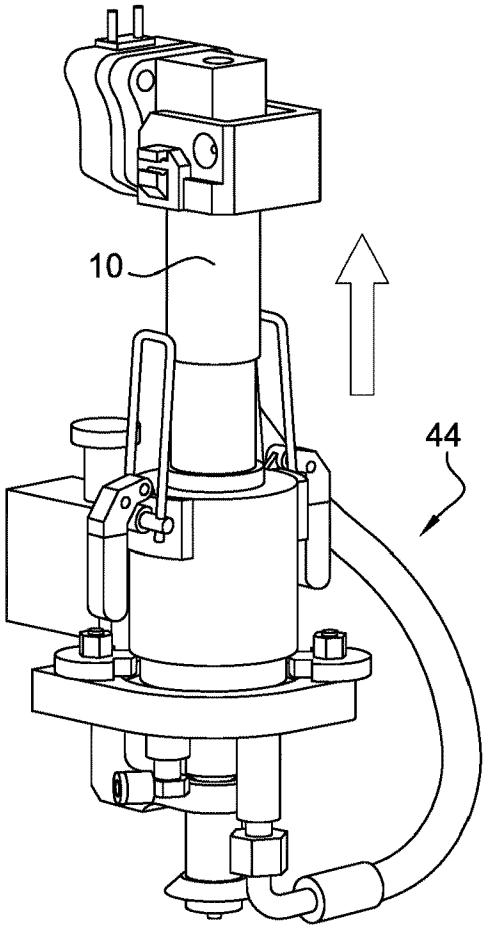
FIGS. 18, 19 and 20 detail the sequence of operations for disassemble the injector from the mounting feature.
Figure 19:
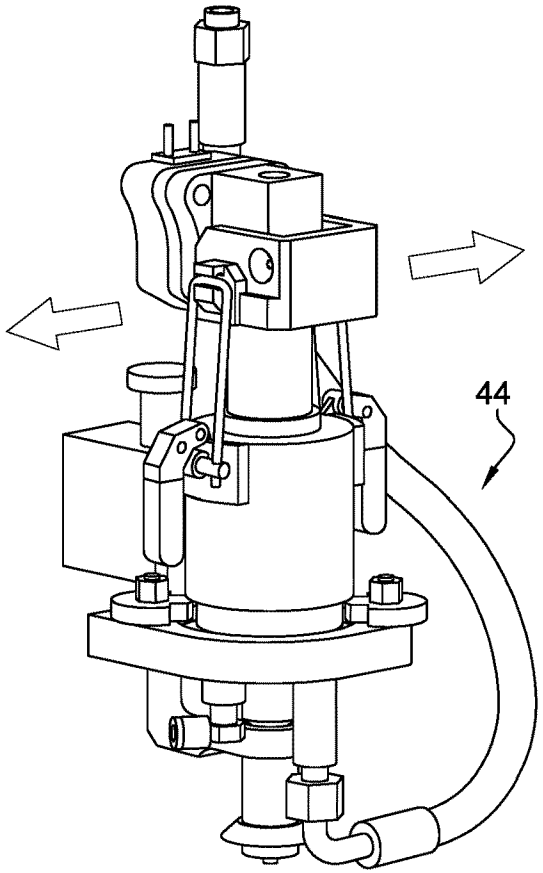
Figure 18:
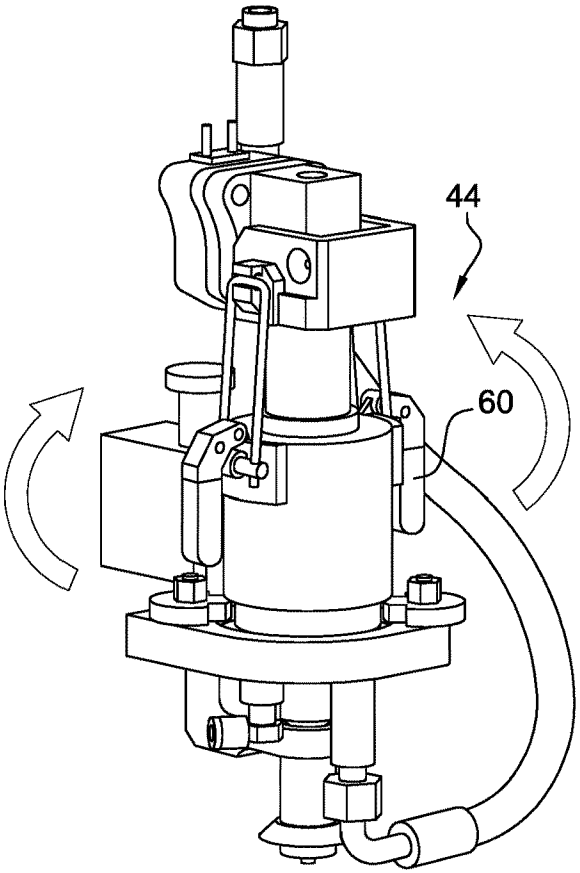

Thanks to this arrangement an operator can easily set an injector in the machine, this operation being done manually just by pulling the handles of the toogle clamps without any needs for tools. The forces generated by the toogle clamps 60, once stretched by the handles, are sufficient to maintain the injector in place and, a test using a fuel flow for instance at 300 bars can be performed. This assembly of an injector on the test machine is illustrated by the sequence represented on FIGS. 15-17, the arrows indicating the direction of insertion of the injector in the sleeve, the direction for engaging the rectangular rings in the hooks and the direction of pulling the handles. The opposite operation of disassembling said injector is shown on the FIGS. 18-20.

In the embodiment presented the sleeve 48 is fixed to the base member 46 and the base member 46 is articulated about the main frame. In another embodiment not shown, the base member 46 may be fixed relative to the frame and, the sleeve 48 may be provided with a device to enable tilting of the sleeve relative to the base member.

To run the machine, an operator arranges the injector in the machine then he/she selects the test to be performed on the digital display 40. By selecting a particular test and a specific injector 10 a set of input signals is sent to the command unit 43 wherein in a memory all the test procedures are stored and all the different type of injectors that can be tested on said machine.

Setting an injector on the machine for performing a test involves running the following method 100 steps:

102) providing an injector 10 to be tested;

104) providing the sleeve 48 adapted to the injector provided;

106) tilting the base member 46 to the mounting position PM;

108) clamping said sleeve 48 on the base member;

110) inserting the injector chosen at step 102) into the sleeve;

112) rigidly fixing said injector by downwardly pulling the handles of the latch toggle clamps 60;

114) tilting the base member 46 back to the test position PT;

116) locking the base member 46 into said test position PT;

118) closing the door 38 of the access opening 36;

120) selecting on the digital display 40 the type of injector to be tested;

122) selecting on the digital display 40 the test to be executed.

When the test is completed the injector 10 is removed from the machine 30 in following the steps of the following method 140:

142) accessing the injector 10 that has been tested and tilting the base member 46 to the mounting position PM;

144) releasing the latch toggle clamps 60 by upwardly pulling the handles of said latch toggle clamps;

146) removing the injector 30 from the sleeve 48.

LIST OF REFERENCES

X longitudinal axis
PM mounting position
PT test position
10 fuel injector
10S side feed fuel injector
10T top feed fuel injector
12 nozzle
14 actuator assembly
16 head end of the injector
18 connector
20 tip end of the nozzle
22 injection holes
24O Engine oil gallery
24S side feed injector diesel fuel inlet
24T top feed injector diesel fuel inlet
30 test machine
32 walls
32F front wall
34 test chamber

36 access opening
38 door
40 display
42 emergency stop button
43 command unit
44 test feature
45 lock
46 base member
46B bottom side of the base
46T top side of the base
48 interface member—sleeve
48U upper end of the sleeve
48L lower end of the sleeve
49 under face of the sleeve
50 pipe
51 channels
51O oil channel
51D diesel fuel channels
52 bore
54 wall
56 notches
58 clamping plates
60 latch toogle clamps
62 recess
64 central opening
66F positioning slot
66M positioning pin
68 flat
72 U-shape member
74 hook
75 inlet block
100 method to perform a test
102 providing step
104 providing step
106 tilting step
108 clamping step
110 inserting step
112 fixing step
114 locking step
116 locking step
118 closing step
120 selecting step
122 selecting step
140 method to remove an injector after test completion
142 accessing step
144 releasing step
146 removing step

The invention claimed is:

1. A test machine adapted to perform high pressure fuel injector tests on several types of fuel injectors, any of said several types of fuel injectors having an injector body extending along a longitudinal axis from a head to a spray nozzle tip, the head being provided with an electric connector for transmitting command signals to an actuator cooperating with a valve member which controls spray through holes provided in said spray nozzle tip, said test machine comprising:

a test chamber, wherein any of said several types of fuel injectors can be fixed on a test feature by means of manually operable clamps and wherein said manually operable clamps comprise latch toggle clamps.

2. A test machine as claimed in claim 1, wherein each of the toggle clamps comprise a handle articulated about a fixation member for stretching a resilient ring, said fixation member being fixed to the test feature.

3. A test machine as claimed in claim 2, wherein said resilient ring is engaged in a hook arranged on the head.

4. A test machine as claimed in claim 1, wherein said test feature comprises a base member on which is arranged an interface member, said base member being attached to the test machine and being common to all of said several types of fuel injectors, and the interface member being specifically designed for a particular one of said several types of fuel injectors.

5. A test machine as claimed in claim 4, wherein said interface member is a sleeve provided with a through bore adapted to receive a nozzle of the injector wherein it is sealingly inserted, the head of the fuel injector protruding outside the sleeve.

6. A test machine as claimed in claim 5, wherein the sleeve is further provided with drillings for inter-connecting a high pressure fuel inlet to an injector fuel inlet.

7. A test machine as claimed in claim 5, wherein the base member is moveable relative to the test machine and, the sleeve is fixed onto the base member.

8. A test machine as claimed in claim 5, wherein the base member is fixed relative to the test machine and the sleeve is moveable relative to the base.

9. A test machine as claimed in claim 4, wherein said test feature is adapted to move between a mounting position and a test position, the mounting position being suitable for arranging the injector on said test feature, and the test position being suitable for performing testing on said injector.

10. A test machine as claimed in claim 9, wherein in said test position the longitudinal axis is substantially parallel to an opening access provided to enable an injector to be entered and installed in said test chamber.

11. A test machine as claimed in claim 10, wherein in said mounting position, the test feature is tilted toward said opening access to ease installation of the injector on the test feature.

12. A test machine as claimed in claim 11, wherein in said mounting position the longitudinal axis of the injector arranged in the interface member extends through said opening access.

13. A test machine as claimed as in claim 1, further comprising an electronic command unit in a memory of which test methods executable by the test machine are uploaded.

14. A test machine as claimed in claim 13, further comprising a display connected to said command unit for an operator to select a particular test.

15. A test machine as claimed in claim 14, wherein the test machine has a substantially parallelepiped body enclosing said test chamber, said body having a front wall provided with said access opening.

16. A test machine as claimed in claim 15, wherein said display is arranged on the front wall, above the access opening.

17. A method of using the test machine as claimed in claim 15, said method comprising the steps of:

providing the injector to be tested;
providing the sleeve adapted to the injector;
tilting the base member to the mounting position;
clamping said sleeve on the base member;
inserting the injector into the sleeve;
rigidly fixing said injector by downwardly pulling the handles of the latch toggle clamps;
tilting the base member back to the test position;
locking the base member into said test position;
closing the access opening by means of a door;

selecting on the display the type of injector to be tested; and selecting on the display the test to be executed.

18. The method of claim 17 further comprising the following steps after the steps of claim 17:

accessing the injector that has been tested and unlocking and tilting the base member to the mounting position;

releasing the latch toggle clamps by upwardly pulling the handles of said latch toggle clamps; and removing the injector from the sleeve.

19. A test machine as claimed in claim 1, wherein said manually operable clamps are configured to clamp any of said several types of fuel injectors against said test feature.

* * * * *